United States Patent [19]

Orestano

[11] Patent Number: 4,878,585

[45] Date of Patent: Nov. 7, 1989

[54] SPORTBOARD WALL-DISPLAY SAFETY-HANGER FIXTURE

[76] Inventor: Andrew J. Orestano, 8706 Mariposa St., La Mesa, Calif. 92041

[21] Appl. No.: 130,436

[22] Filed: Dec. 9, 1987

[51] Int. Cl.[4] ..... A47F 7/00

[52] U.S. Cl. ..... 211/87; 248/205.2; 248/309.1

[58] Field of Search ..... 211/87, 60.1, 89; 248/205.2, 309.1; 224/226, 917

[56] References Cited

U.S. PATENT DOCUMENTS

| | | | |
|---|---|---|---|
| 3,680,820 | 8/1972 | Gracie | 284/314 |
| 3,749,348 | 7/1973 | Bartlett | 211/64 X |
| 4,019,632 | 4/1977 | Greenlee | 206/349 |
| 4,114,787 | 9/2978 | Rosenkaimer | 224/226 |
| 4,212,399 | 7/1980 | Penney | 211/35 |
| 4,245,807 | 1/1981 | York | 248/310 |
| 4,285,082 | 8/1981 | Cox | 9/310 |
| 4,483,380 | 11/1984 | Beran | 150/52 |
| 4,518,107 | 5/1985 | Amos | 224/215 |
| 4,635,800 | 1/1987 | Stempin | 211/70.5 |

*Primary Examiner*—Robert W. Gibson, Jr.

[57] ABSTRACT

A special non-rigid wall-display 'hanging apparatus' in the form of a T-harness, suitable for convenient storing of a Sportboard article such as a surfboard, skateboard, snowskis, waterskis, or similar shaped article, safely out of harms way; while providing a space-saving advantage as well at an economical cost factor, since the primary material of construction is conventional woven-nylon or equivalent type strap-webbing which is cut to suitable lengths and assembled of essentially two pieces of a T-formation; whereby the lower/vertical-portion includes a special nose-stirrup achieved via a twisted-loop end finally lap-joined back to the said vertical, thereby serving to support primary vertical-loads; and an upper/Horizontal-portion consisting of oppositely extending T-straps of sufficient length as to be wraped about the board mid-body region, whereby the overlapping-ends thereof are instantly secured via integral fasteners; the said vertical T-strap member having an upper body primary/hanger-gromment, plus a lower body secondary/hanger-gromment for lateral stability, or for hanging at an attractive oblique-angle if desired; the soft flacid T-hanger configuration being non-scratching and very compactly packaged or stored.

9 Claims, 1 Drawing Sheet

FIG.-1
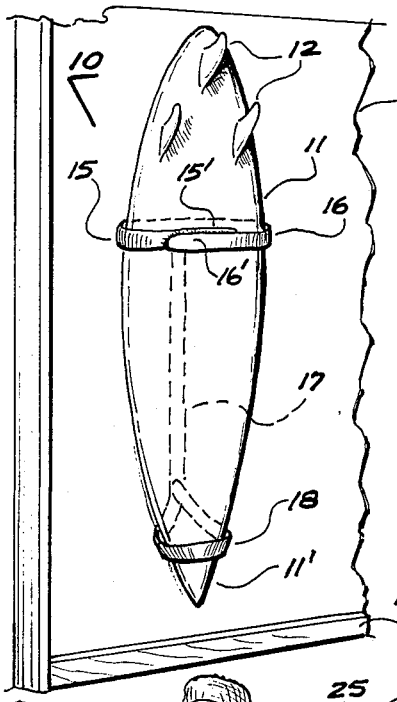
FIG.-2
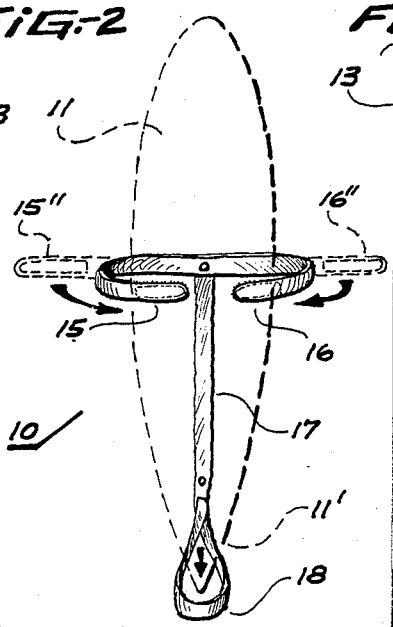
FIG.-3
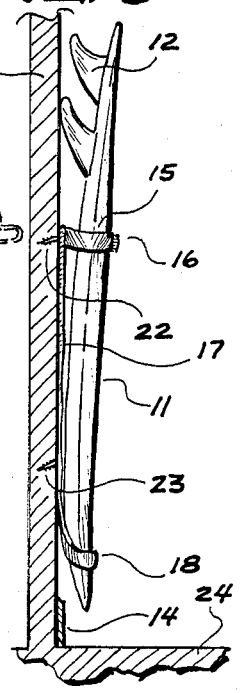
FIG.-4
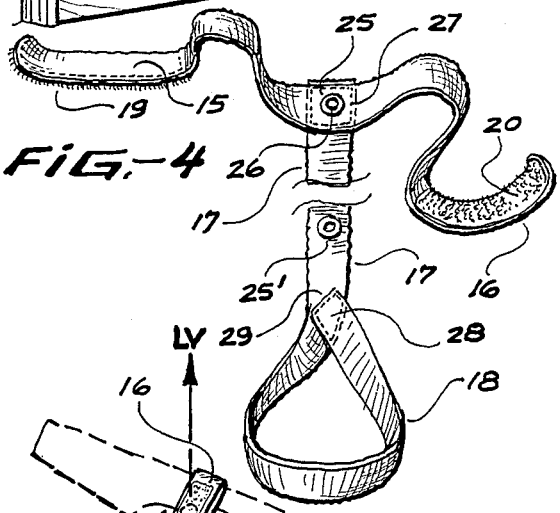
FIG.-5
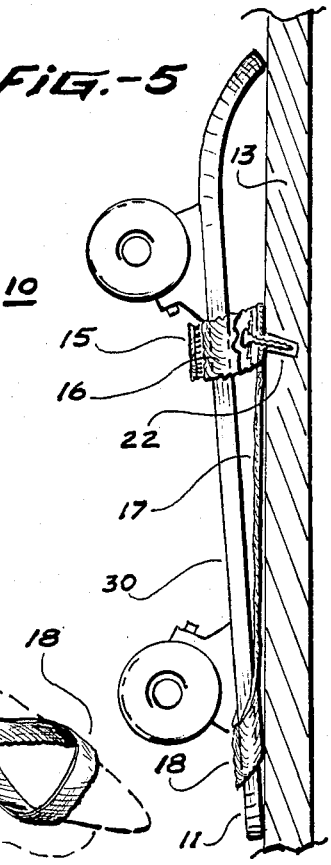
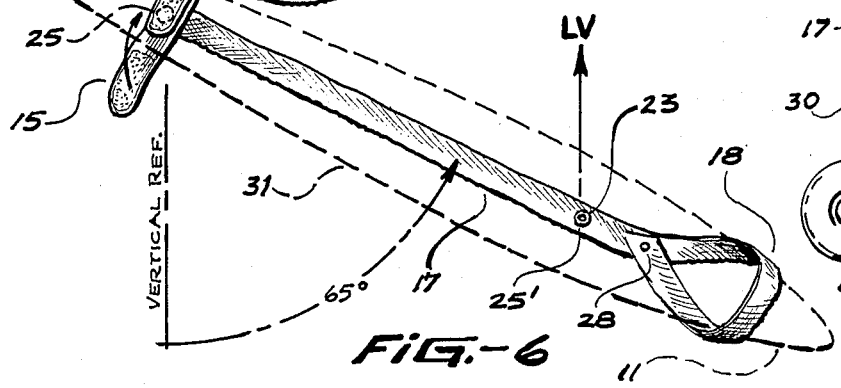
FIG.-6

SPORTBOARD WALL-DISPLAY SAFETY-HANGER FIXTURE

FIELD OF THE INVENTION

This invention relates generally to devices made so as to provide a means of wall-hanging sports equipment such as surfboards and skis(water or snow), for storage or attractive display--- since owing to their relatively long physical length-to-width ratio, and absense of integral hanging facility, a special hangining-device is desirable.

BACKGROUND OF THE INVENTION

While there are various types of wall/hanger-devices on the market, owing to the unusual dimensional size of most surfboards and skis for example, they are most often merely stored in the garage upon the rafters, or simply proped-up in the corner where they are subject to damage. Frequently, due to their length, a surfboard, or a pair of skis, will inadvertantly be nudged over by something else while proped-up against the wall, causing the costly sports item to fall fast to one side in a fairly pivotal motion relative to the floor upon which they are usually resting. While most probably damaging to the item, is also potentially harmful to some other object as well, particularly a child or family pet happening to be in the sector of the fall. Additionally, the popular teenage Skateboard, while not very long physically, poses a threat-to-safety not any less dangerous than that long attributed to ordinary Roller-skates--- in that a person walking in a low-light condition particularly, may secumb to a major if dibilating fall.

Hence, the 'safety aspect' of providing a specially configured apparatus capable of even attractively hanging the said sports items, is considered of exceptional importance to the usage, or perhaps more appropriately, the non-usage of such sports-equipment, in a truly 'safe'-modality of storage. Therefore, it was determined that a simple, low-cost, yet durable and reliable means for achieving quick & easy wall-storage was desired, --which would also possibly save valuable space in a crowded living-space as yet another benificial result.

SUMMARY OF THE INVENTION:

The foregoing contengencies now in mind, it is the object of this invention to setforth a special universally adaptable wall/safety-hanger fixture, wherein is provided an essential 'T-harness'affair, preferably constructed of substantially standard flexible nylon-strap webbing stock, and having a lower nose-stirrup looped portion thereto, plus at least one upper-body hanger-grommet or equivalent hanging provision stationed at the 3-way intersection of the T-arms or T-straps thereto; thereby facilitating: (a.) the easy 'drop-in' insertion of the 'nose' portion of the Surfboard, Ski, or Skateboard (to be hereinafter referred to in a general generic sense of terms, as the 'Sportboard', in as much as all the said sport items are employed by the feet to plane over upon a given surface, be it water, snow, or pavement) down into the said nose-stirrup, where it is simply held via force-of-gravity; then, (b.) quick manual encirclement of the distended T-straps about the upper mid-body of the Sportboard, where they are engageably joined together via conventional fastener means; thereby securely retaining the Sportboard upon the wall or door-panel until retrieved just as quick & easy through reverse of the preceeding steps.

Another object of this invention is to setforth an article according to the preceeding example, whereby the resulting wall-hanging arrangement facilitates an ideal display-fixture, suitable for Retail-store 'sales displaying' of the said Sportboard products; while on the other hand, it is also possible that for out-of-sight security-storage purposes it is desirable to employ the same said T-harness apparatus behind a bedroom or closit door for example, whereby an intruding their might tend to overlook the fairly concealed Sportboard item stored in a somewhat less conspicuous manner than the former said wall-display.

Another object of this invention is to setforth a basic mode of construction for a special T-harness having the various previously said type of Sportboard uses, yet realizing that the considerable differences in physical size of a skateboard as relative to a surfboard, all be it they are of somewhat similar physical proportions, would suggest that a specialized T-harness be produced specifically for the particular type of Sportboard product to be so hung; however, it is nevertheless possible to also produce a T-harness assembly replete with suitably adjustable T-straps, as well as the nose-stirrup, as to be virtually universally adaptable in but a single embodiment--- although it is not really the most preferred embodiment of this invention per3 se, since the cost and complexity would be unattractive.

It is another object of this invention to setforth a Sportboard/T-harness capable of safely hanging a surfboard in particular with its rear-stabilizer skagfin(s) facing outwardly or inwardly relative to the wall, but regardless, at the top of the hanging affair, so as to be positioned above the height of a persons head, so as to obviate change occurance of one's accidently walking into these sharp fins in a low-light condition for example; thereby further reducing the chanch for pesonal injury, were the surfboard merely proped nose-down against the wall as Surfers are want to do, which usually places the said fins at eye-height.

Another object of this inventio is to setforth a Sportboard/T-harness wherein is employed an instantly self-adjustable upper T-strap arrangement, via use of a generous length of Velcro R fasteners at the ends of each opposing T-strap, thereby allowing their respective hook & loop entities to thus engage at the exact resulting circumferenital dimension for any given Sportboard width & thickness encountered.

Another object of this invention is to setforth a Sportboard/T-harness wherein is provided a said layer nose-stirrup whose particular loop-pocket like formation is preferably attained by forming an encircling wrap around toward itself, while joining the final end portion without a twist to the still vertical T-strap body via an oblique intersection or inverted-y formation generally having a 30–45 degree angle-of-bisect inside the loop, depending upon the girth of the Sportboard-nose being accomodated therein; this said inverted-y angle being preferably made fixed via a simple sewing proceedure of attachment; however, the said nose-stirrup angle could be made rather self-adjusting by merely joining the intersection of harness strap material via a single loose rivet loose grommet or conventional snap-fastener, acting in effect as a pivotal structual member snap-fastener would work as well.

Another object of this invention is to setforth a Sportboard/T-harness wherein the primary body of material is of substantially conventional woven-nylon strap like belting, or the equivalent such as dacron or even non-woven extruded plastic exhibiting a similar flexural quality, the latter even possibly being assembled via ultra-sonic fusing method in contrast to the more costly sewing process, were the finished T-harness to be made as a promotional give-away item for example.

Another object of this invention is to setforth a Sportboard/T-harness wherein the previously said upper-body/hanger-grommet is augmented with another however similar lower-body/hanger-grommet stationed down more adjacent to the said nose-stirrup, thereby providing improved resistance against any tendancy of the hanging aggregation to swing or tilt sideways from the vertical, in pendulem fashion; or, the hanging aggregation may be desirably positioned fixed upon the wall at a more dynamic appearing 45–60-degree angle from the vertical if desired, by merely securing the wall-fasteners (screws, nails, etc.) at such laterally oblique points as to result in the preferred angled-hanging attitude.

Accordingly, it is to be understood that this invention will be further described in conjunction with certain preferred embodiments, hence, it is intended that the invention as is setforth herein will not be limited to such specific features; on the contrary, it is intended to cover all associated alternatives, modifications, and practical equivalents which may be found within the spirit & scope of the invention, as is further defined in the following Specifications and appended claims.

BRIEF DESCRIPTION OF THE DRAWINGS

FIG. 1, is a ¾-oblique side pictorial view of the invention as it appears in a fully installed condition holding a surfboard (per example); including a portion of vertical-wall thereto as a typical environment.

FIG. 2, is a full-frontal/elevational-view of the invention as portrayed in FIG. 1, showing the manner by which the invention is installed; including an exemplified surfboard thereto indicated via phantom Ref.-outline for greater clairty of understanding.

FIG. 3, is a full-side/elevation-view of the invention as it is substantially portrayed in the preceeding two views, although the surfboard is shown in an alternate condition wherein the fins are facing inward; including a cross-section of room wall to better convey the relationship of related things.

FIG. 4, is an enlarged detail frontal/elevation-view of the obviously flexile invention alone as it would much appear for example prior to installation upon a wall or door; wherein the veritcal-strap holding the nose-stirrup portion is shown broken with a portion missing, so as to suggest that the length may be acutally made to any preferred length appropriate to securing of the Sportboard as is revealed.

FIG. 5, is an alternate side/elevation-view, herein revealing the manner in which a conventional skate-board may be wall-hung for safety & display purposes.

FIG. 6, is an alternate frontal-view of the invention wherein an oblique attitude of installation is demonstrated, here employing a waterski per example.

SPECIFICATIONS OF THE PREFERRED EMBODIMENT

Study of FIG. 1 discloses the overall appearance of the T-harness invention 10 as it appears with a conventional surfboard 11 installed in a secure wall-hanging condition, with the customary skag-fins 12 here facing outward allowing the Sportboard to be held substantially flat against the wall 13 having usual baseboard 14 conveying a rather typical installation setting. Adjacent FIG. 2 somewhat better demonstrates the way the distended T-straps 15″/16″ are simply, abet manually, wraped about the body of the Sportboard 11 as suggested by illustratively detained positioning 15/16, and also note how the nose 11′ portion is just about to enter the naturally slung nose-stirrup 18 as is suggested via the central Ref.-arrow. Hence, virtually as simple as: (1.) inserting the said nose into the said saddle; (2.) drawing opposed T-straps around the Sportboard mid-body; and, (3.) securing T-strap ends 15′/16′ together via conventional strap-fasteners 19/20 which are preferably of the well known Velcro R type having engaging hooks & loops, as is better shown in FIG. 4.

The adjacent side-view of FIG. 3 reveals the alternate manner of installing the exemplified surfboard, with the skag-fins 12 facing inward in the most safety oriented manner; and, it also reveals the manner by which the T-harness is centrally hung or suspended upon wall 13 via a standard oval-headed/pan-screw 22 preferably (or ordinary nail), as the primary if essential hanger-point, while the lower region is provided with an optional hanger-screw 23. Besides the already identified features of the T-harness 10, an ordinary room-floor portion 24 is seen extending thereunder as environmental reference.

The enlarged frontal-view of FIG. 4 better reveals the very flacid nature of the invention, obviating any rigid members such as usual brackets, since the flexile T-strap elements 15,16,17 are all under some amount of tension, particularly member 17 which generally really carries most of the gravity-load of any Sportboard product being retained thereto. Note how an ordinary brass-grommet 25 is always preferably employed as the primary hanging element via concentric-hole 26 through which earlier said screw(or picture-hanger hook) is engaged. The screw-fastener is ordinarily provided with the invention when packaged for sale, along with a suitable wall-sink (although a one-piece screw-sink or Molly can be used as well for a likewise clean installation). Also, it is preferred that a lower secondary hanger-grommet be included at point 25′ so as to further stabilize the positioning of the assembly, but again hanger-grommet 25 is the essential one. Besides the large retensionflanges of the said grommet 25/25′ it is also preferable to sew a rather squareish perimeter-pattern there arround at strap lap-regions 27/29 for added reinforcement.

Note also how in FIG. 4 the one-piece loop-formation of the nose-stirrup 18 simply bends around without a torsional-twist, and back upon itself to be permanently joined at point 29 via said sewn means, although an alternate means via snap-fastener or rivet centrally to point 28 would facilitate a rather self-adjusting variableangle of loop-attachment; however, the producer belives the loop-angle can be satisfactorily set for the particular type of Sportboard product to be hung, since it is preferred that a T-harness be exactly proportioned for the specific type of Sportboard anyway, --thereby eliminating any need for supplemental adjustment means to the T-straps 15,16,17.

Reference to FIG. 5 shows a skate type Sportboard 30 being likewise wall-hung via the suitably smaller T-harness 10 wherein a single wall-screw 22 is indicated as adaquate, unless the owner wishes to display the Sportboard at an attractive, if more dynamic oblique angle as is demonstrated in FIG. 6, wherein the exemplifies waterski type Sportboard 31 is well inclined from the vertical to a 65-degree angle; and whereby reference-arrows LV serve to indicate the resulting 'load vectors' as distributed upon the T-harness gromments 25/25' in this modality.

In the drawings and specifications there has been setforth the best mode presently contemplated for the practice of the present invention, and although specific terms are employed, they are used in a generic if descriptive sense only and not for purpose of limitation upon the spirit & scope fo the invention, as is defined in the appended claims.

That which is claimed is:

1. A special T-harness apparatus constructed of flexible strap material for wall or door hanging of various types of 'sportsboards' and similar articles; comprising:

an upper portion of the T-harness having first and second arm members, each outer end portion thereto having an integral mating fastener means facilitating 180-degree wrap-around of both said strap members relative to the body of the thus captive sportboard;

a third and lower T-strap extension member stemming centrally down from the said upper opposed T-strap arm members at a right-angle, and including an integrally formed bottom most inverted-Y nose stirrup arrangement into which the sportboard-nose is inserted so as to become retentively seated therein via force-of-gravity.

an first and second upper hanger means, located approximately at the junction point of all three T-strap members, and capable of engaging upon a wall-hanger device such as a conventional protruding nail, screw, or picture-hanger type device, and thereby providing a basic vertial hanging modality via a single point.

2. A T-harness sportboard hanger apparatus according to claim 1, wherein said opposed T-strap fastening means is via well known hook-and-loop strap mating portions.

3. A T-harness sportboard hanger apparatus according to claim 1, wherein said upper T-strap arms are preferably formed from a single length of substantially standard woven-nylon strap material, whereby the said lower T-strap extension is also preferably of the same type material and joined to the said upper T-strap arms via sewn method.

4. A T-harness sportboard hanger apparatus according to claim 1, wherein said upper T-straps and said lower T-strap may be equipped with an additional adjustable strap arrangement, whereby the said strap members may be manually lengthened/ shortened according to the proportional dictates of the article being so hung.

5. A T-harness sportboard hanger apparatus according to claim 1, wherein the said nose-stirrup is preferably formed by means of a simple non-torsionally twisted return-loop wrapping arrangement, whereby the upended final end is preferably overlapped upon the extended lower T-strap member where it is overlap-sewn at a suitable intersecting inverted-V angle of between 15–60 degrees depending upon the particular type of sportboard of similar article being accomodated therein.

6. A T-harness sportboard hanger apparatus according to claim 1 wherein the said nose-stirrup is preferably formed by means of a simple non-torsionally twisted return-loop wrapping arrangement, whereby the upended final end is preferably overlapped upon the extended lower T-strap member where it is pivotally attached via a single loose rivit, loose grommet, or ordinary snap-fastener, so as to provide a manner of self-adjustability to the nose-stirrup inverted-Y loop-angle, according to the particular article being held therein.

7. A T-harness sportboard hanger apparatus according to claim 1, wherein an optional lower hanger means, located at or approximately above the inverted three-way strap junction, is capable of engaging upon another conventional wall-hanger device likewise to the said upper hanger, and thereby providing the capability for additional vertical-hanging stabilization or to facilitate an oblique non-vertical hanging arrangement by thus sharing some of the vertical loads in a laterally offset manner.

8. A T-harness sportboard hanger apparatus according to claim 1, wherein said opposed T-strap fastening means is via well known conventional mechanical-snaps.

9. A T-harness sportboard hanger apparatus according to claim 1, wherein said opposed T-strap fastening means is via well known conventional belting and buckle arrangement.

* * * * *